US005349707A

United States Patent [19]

Last

[11] Patent Number: 5,349,707

[45] Date of Patent: Sep. 27, 1994

[54] SPLIT STOP FOR AUTOMATIC SWIMMING POOL COVERS WITH A HYDRAULIC DRIVE SYSTEM

[76] Inventor: Harry J. Last, 482 W. Latimer, Campbell, Calif. 95008

[21] Appl. No.: 117,293

[22] Filed: Sep. 7, 1993

Related U.S. Application Data

[63] Continuation-in-part of Ser. No. 913,796, Jul. 16, 1992, Pat. No. 5,327,590, which is a continuation-in-part of Ser. No. 741,480, Nov. 28, 1991, Pat. No. 5,184,537, which is a continuation-in-part of Ser. No. 494,564, Mar. 16, 1990, Pat. No. 5,067,184, which is a continuation-in-part of Ser. No. 258,000, Oct. 17, 1988, Pat. No. 4,939,798.

[51] Int. Cl.[5] ..... E04H 3/19

[52] U.S. Cl. ..... 4/502

[58] Field of Search ..... 4/498, 502

[56] References Cited

U.S. PATENT DOCUMENTS

| | | | |
|---|---|---|---|
| 3,979,782 | 9/1976 | Lamb | 4/502 |
| 4,811,433 | 3/1989 | MacDonald et al. | 4/502 |
| 4,815,152 | 3/1989 | MacDonald et al. | 4/502 |
| 4,939,798 | 7/1990 | Last | 4/502 |

*Primary Examiner*—Charles E. Phillips
*Attorney, Agent, or Firm*—David E. Newhouse

[57] ABSTRACT

A split stop is described having a top member with a mating surface with two parallel half cylinder channels with lands defining an alignment slot between the channels which seats on base member with a complementary mating surface defining two parallel half cylinder channels but with a central alignment rail aligned between the channels and extending perpendicularly from one side. The mated surfaces of the top and base members define a cylindrical rope channel, and a cylindrical beaded tape channel with a longitudinally communicating gap. The alignment rail extending perpendicularly from the side of the base member is dimensioned for insertion into a rectangular space between the respective "C" and rope channels of typical pool cover track to assure alignment of the rope and beaded tape channels of the split stop with the corresponding rope and "C" channels of the track. The invented split stop is adapted to be secured at the respective ends of a pair of swimming pool cover tracks for positively arresting translation of a slider sliding within "C" channels of the track supporting a rigid leading edge of a swimming pool cover above a swimming pool.

14 Claims, 4 Drawing Sheets

SPLIT STOP FOR AUTOMATIC SWIMMING POOL COVERS WITH A HYDRAULIC DRIVE SYSTEM

RELATED APPLICATIONS

This application is a continuation-in-part of application Ser. No. 07/913,796 filed by the applicant Jul. 16, 1992 entitled "AUTOMATIC SWIMMING POOL COVER WITH A DUAL HYDRAULIC DRIVE SYSTEM" now U.S. Pat. No. 5,327,590, which is a continuation-in-part of U.S. Pat. No. 5,184,537 issued Feb. 9, 1993 to the applicant also entitled "AUTOMATIC SWIMMING POOL COVER WITH A DUAL HYDRAULIC DRIVE SYSTEM" resulting from application Ser. No. 07/741,480 filed Nov. 28, 1991 in the United States of America by the applicant which was entitled to a priority filing date of Jul. 24, 1990 under treaty provisions of the Patent Cooperation Treaty (PCT), International Application No. PCT/US90/04157. Application Ser. No. 07/741,480 in turn is a continuation-in-part of application Ser. No. 07/494,564 filed Mar. 16, 1990, now U.S. Pat. No. 5,067,184 issued Nov. 26, 1991 to the applicant, Harry J. Last, entitled "A COVER DRUM HAVING TAPERED ENDS FOR AN AUTOMATIC SWIMMING POOL COVER." U.S. Pat. No. 5,067,184 is a continuation-in-part of application Ser. No. 07/258,000 filed Oct. 17, 1988, now U.S. Pat. No. 4,939,798 issued Jul. 10, 1990 to applicant, Harry J. Last, entitled: "LEADING EDGE AND TRACK SLIDER FOR AN AUTOMATIC SWIMMING POLL COVER".

BACKGROUND OF THE INVENTION

1. Field of the Invention

The invention relates to automatic swimming pool cover systems, and in particular, to hydraulic drive systems which rotate the cable reels and cover drum for extending and retracting pool covers back an forth across a swimming pool.

2. Description of the Prior Art

Automatic swimming pool cover systems typically include a flexible vinyl fabric sized so that most of it floats on the surface of the pool water. The pool water acts as a low friction surface significantly reducing the amount of force required to move the cover across the pool. The front edge of the cover is secured to a rigid boom spanning the width of the pool for holding the front edge of the cover above the water as it is drawn back and forth across the pool.

To draw the cover across the pool, a cable, typically a Dacron line, is incorporated into and forms a beaded tape which is sewn or attached to the side edges of the pool cover. The beaded tape in turn is captured and slides within a "C" channel of an extruded aluminum track. The track is secured either to the pool deck or to the underside of an overhanging coping along the sides of the swimming pool. The cables extending from the beaded tape sections of the cover are trained around pulleys at the distal ends of the tracks and return in a parallel "C" channel to the drive mechanism where they wind around cable take-up reels.

To uncover the pool, the drive mechanism rotates a cover drum mounted at one end of the pool winding the pool cover around its periphery and unwinding the cables from around the take-up reels. To cover the pool the drive mechanism rotatably drives the cable take-up reels winding up the cables to pull the cover across the pool unwinding the cover from around the cover drum.

In related application Ser. No. 07/913,796 filed Jul. 16, 1992 and in U.S. Pat. No. 5,184,357 issued Feb. 9, 1993, the applicant describes automatic swimming pool cover systems wherein a first hydraulic drive provides torque for resisting cover drum rotation during cover extension and for rotating the cover drum for cover retraction, while a separate second hydraulic drive provides torque for rotating the cable reels for cover extension and for resisting cable reel rotation during cover retraction. In the related application and patent, the applicant teaches the desirability of having positive stops located at the respective ends of the pool for stopping movement of the rigid leading edge carrying pool cover by increasing tension load on the cover and cables sufficiently for counter-balancing the torque of the particular driving hydraulic motor rotating either the cable reels or cover drum. He points out that such stops need only be able to mechanically withstand the differential load of the driving hydraulic motor rotating the cable reels or cover drum and the opposing tension load imposed by the pumping hydraulic motor resisting rotation of the cover drum or cable reels. In systems utilizing a single reversible hydraulic motor such stops must be able to mechanically withstand the load imposed by the driving hydraulic motor which is typically determined by a pressure relief valve mechanism in located in driving side of the hydraulic liquid ciculation loop.

In under track systems (where the track is fastened to the underside of overhanging copings), the copings or walls at the respective ends of the pool can function as inherent stops arresting cover extension or retraction provided the rigid leading edge appropriately engages the coping or walls. Also, return pulleys at the distal ends of the respective tracks returning the cables to the take-up reels provide inherent positive stops for arresting extension of the cover in that the pulley housings do not have "C" channels and hence will stop the sliders sliding within the "C" channels supporting the rigid leading edge carrying the cover across the pool. [See U.S. Pat. No. 4,939,798 issued Jul. 10, 1990 to applicant, Harry J. Last, entitled: "LEADING EDGE AND TRACK SLIDER SYSTEM FOR AN AUTOMATIC SWIMMING POLL COVER" and U.S. Pat. No. 4,466,144 issued Aug. 21, 1984 to Joe H. Lamb entitled: "PULLEY ASSEMBLY FOR SWIMMING POOL COVER"]

However, in top track systems (where the track is secured to the pool deck) and in other pool configurations, using the walls or copings at the ends of the pool to arrest or stop cover extension retraction by engaging the rigid leading edge is neither feasible nor aesthetic. In fact, many pools are specifically designed to conceal the rigid leading edge of a pool cover under a coping, particularly when the cover is fully retracted. And, in systems where the cable reels and cable drum are located on opposites ends of the pool, there aren't any return pulleys at the distal ends of the track to stop the sliders carrying the rigid leading edge. Accordingly, it is sometimes necessary to provide positive stops terminating the respective proximate and distal ends of the "C" tracks securing the beaded tape side edges of a pool cover which establishes the end points of travel for the sliders sliding within the "C" channels of the track carrying the rigid leading edge.

In many existing automatic pool cover systems, at the proximate end of the tracks adjacent the cover drum, there are cover edge guides which guide the beaded tape side edges of the cover unwinding from the cover drum into the "C" channels of the extruded aluminum track on either side of the pool. In some systems, these cover guides also serve to locate the beaded edge of the cover relative to the cover drum as the cover is wound around the cover drum.

A typical cover edge guide is formed from unitary block of material with a guide channel along at least one side defined by a circular bore with a longitudinal gap communicating from the bore to the side of the cover guide. The channel openings on such cover guides are typically flared to preclude any snagging of the beaded tape edges sliding through the guide. The beaded edge is captured in the circular bore of the guide channel with tape and the cover sliding in the longitudinal gap. The width of the longitudinal slot is typically much less than the side opening of the "C" channel of the track anchoring the cover to the sides of the pool so that the beaded edge cannot slip free of the guide channel. Typically, such cover guides also include an alignment tang or bar shaped for insertion into a rectangular space between the respective "C" channels of the track for assuring alignment of the bore and slot channel of the particular guide with the opening of the "C" channel of the tracks. In essence, cover guides have heretofore simply functioned as tailored extensions of the confining "C" channels of the track proximate the cover drum. Such cover guides are preferably composed of softer materials such as Nylon such that the guide wears rather than the beaded tape cover edges sliding through them. [See U.S. Pat. No. 3,979,782 issued Sep. 14, 1976 to Joe H. Lamb, entitled SWIMMING POOL COVER and U.S. Pat. No. 4,939,798 (supra) FIG. 9, re discussion at Col. 16, 1. 58 through Col. 17, 1.23]

Much to the annoyance of repairmen, because such cover guides are typically formed from unitary blocks of material, the entire cabling extending from the beaded tape edge of the cover be must unwound from the cable reel and pulled through the guide whenever a component of the system including a cover guide must be replaced because of wear or failure. After repair, the entire cable must then be re-threaded and pulled through the guide. Among other requirements, this necessitates removing track sliders secured to the cables supporting the rigid leading edge of the cover (See U.S. Pat. No. 4,939,798). Also, because a cable(s) is completely unwound from around a cable reel, the entire system must then be realigned and re-tensioned.

Also existing cover guides even with flared openings [U.S. Pat. No. 3,979,782] do not address the primary cause of snagging and catching as the beaded tape edge of the swimming pool enters the ends of the "C" channel of the swimming pool track proximate the cover. The primary source of a snags or catches is the abrupt increase in cable diameter at the beaded tape edge of the cover and misalignment of the cover with the slot opening of the track or guide. The abrupt edges at the front edges of the beaded tape on the cable typically catch on the edges of the flared opening particularly when the edge of the cover is not aligned for entry into the slot opening of the guide. Also, the fact that distances between sliders carrying the rigid leading edge and beaded edges of the cover can vary due to stretching, repair, and adjustment further complicate such snagging and catching problems. [See Applicant's U.S. Pat. No. 4,939,798, cols. 15 & 16.]

SUMMARY OF THE INVENTION

The invented split stop includes a top member and a base member which are secured together at end of pool cover track for positively arresting translation of a slider sliding within "C" channels of the track supporting a rigid leading edge of a pool cover above a pool. The top member has a mating surface with two parallel half cylinder channels with lands defining an alignment slot between the channels, seating on a complementary mating surface of the base member having two parallel half cylinder channels but with a central alignment rail between the channels and extending perpendicularly from one side of the member dimensioned to fit into the alignment slot of the top member. The mated surfaces of the top and base members define a cylindrical rope channel, and a cylindrical beaded tape channel with a longitudinally communicating gap. The alignment rail extending perpendicularly from the side of the base member is dimensioned for insertion into a rectangular space between the respective "C" and rope channels of typical pool cover track to assure alignment of the rope and beaded tape channels of the split stop with the corresponding rope and "C" channels of the track. At least two screws received in holes drilled through the spilt stop simultaneously secure the top member to the base member and the stop to a pool deck or coping surface at the ends of the respective tracks on either side of the pool with the alignment rail received in the rectangular space between the respective "C" and rope channels of the track. The beaded tape channel is appropriately dimensioned to arrest translation of the slider at the end of the pool track. In particular, either (i) the distance between the circular bore of the beaded tape channel and the proximate side or 'nose' side of the spilt stop is greater than the length of the necked section of the slider element supporting the rigid leading edge of the cover, and/or (ii) the width of the longitudinal gap of the beaded tape channel is less than the thickness of a necked section of a slider, and/or (iii) the diameter of the circular bore of the beaded tape channel is less than the outside diameter of the hollow cylindrical sliding edge of the slider. To preclude the front edge of the beaded tape and cover from snagging and/or catching, the width of the stop is chosen such that the front edge of the beaded tape and cover remains within its beaded tape channel at the point where translation of the slider is arrested.

In one embodiment of the invented spilt stop, the top member has a nose prong which extends down the track exterior the slot of the "C" channel dimensioned for catching the body of the slider. The top member is movable longitudinally with respect to the base member such that the point at which translation of the slider carrying the rigid edge of the cover is arrested can be adjusted to compensate for changes in the distance between the front edge of the beaded tape and the slider.

Other embodiments of the invented spilt stop incorporates a top and a base members secured to the deck or coping at an end of the swimming pool track sandwiching slotted sleeve inserts having raised annular collars or other means at one end for anchoring it between the top and base members to prevent it from translating. The slotted sleeve extends down the "C" channel of the track reducing the diameter of the channel to less than the outside diameter of a slider carrying the rigid leading pool cover edge. The length of the slotted sleeve determines the point at which translation of a slider is arrested in the "C" channel of the track. Adjustment is accomplished by either substituting a longer sleeve or by shortening an existing sleeve.

The mating surfaces of the top and base members of the invented spilt stop may also include a shoulder land on one of the surfaces and a corresponding relief cut into the other surface located at or proximate the 'tail' side of the stop to enhance the rigidity of the coupling between the mating surfaces. Such tail lands and reliefs also facilitate installation and replacement in that an installer/repairman can easily distinguish between the tail and nose of the top and base members of the stop.

The invented spilt stop is designed to provide a positive stop to translation of sliders carrying the leading edge of the pool cover particularly as the cover is wound around the cover drum, retracting the cover. Such stops are also necessary to arrest cover extension particularly in drive systems where the cover drum and cable reels are located at the opposite ends of the pool.

DETAILED DESCRIPTION OF PREFERRED AND EXEMPLARY EMBODIMENTS

For purposes of context, and understanding the interaction of invented split stop with the components a track and slider, automatic swiming pool cover system, Please refer to Applicant's U.S. Pat. No. 4,939,798 entitled: "LEADING EDGE AND TRACK SLIDER SYSTEM FOR AN AUTOMATIC SWIMMING POLL COVER."

Figure 1:
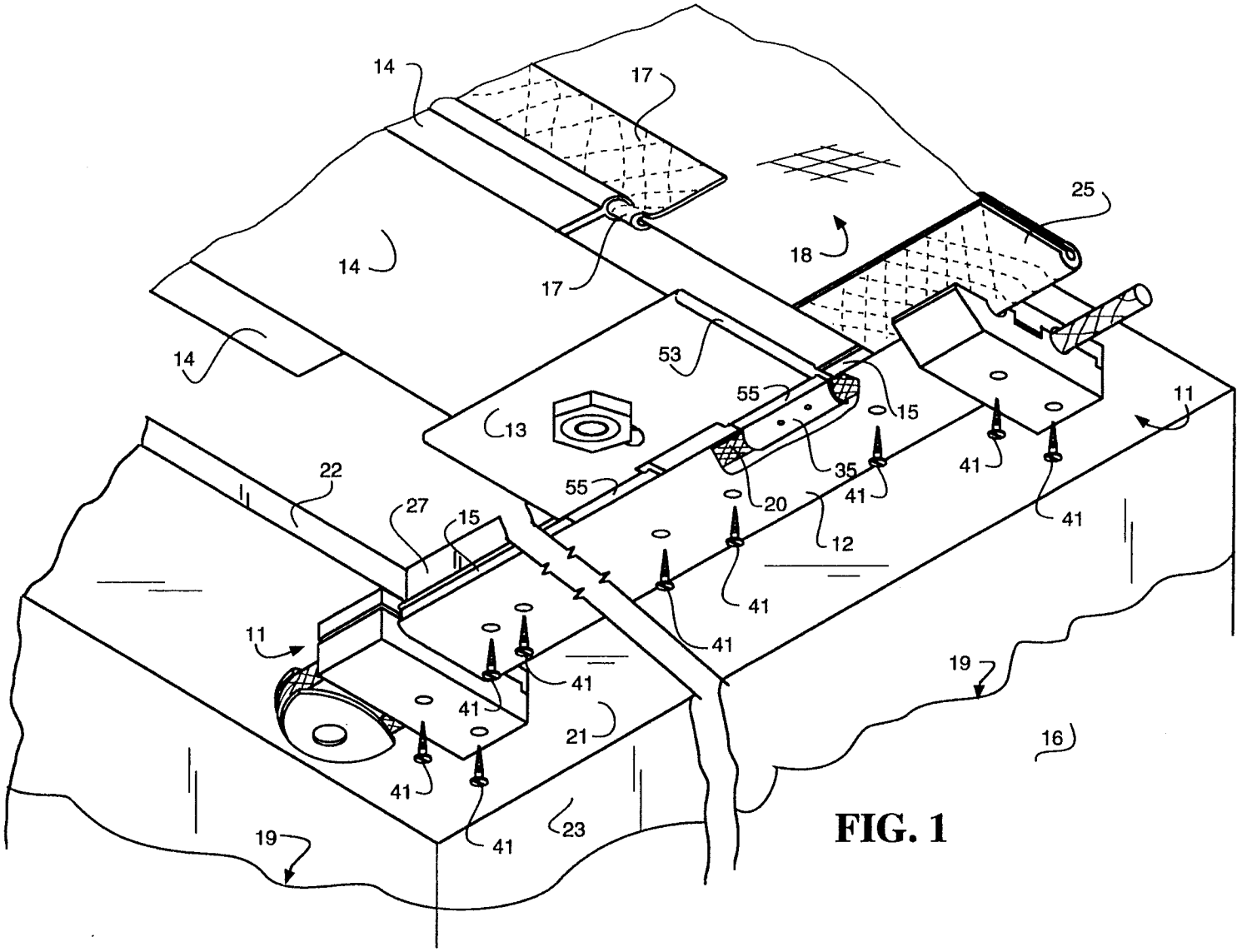
FIG. 1 is a perspective rendering showing the invented spilt stops located at each end of a conventional swimming pool track secured to the bottom surface of an overhanging coping along one side of a swimming pool.
Figure 2:
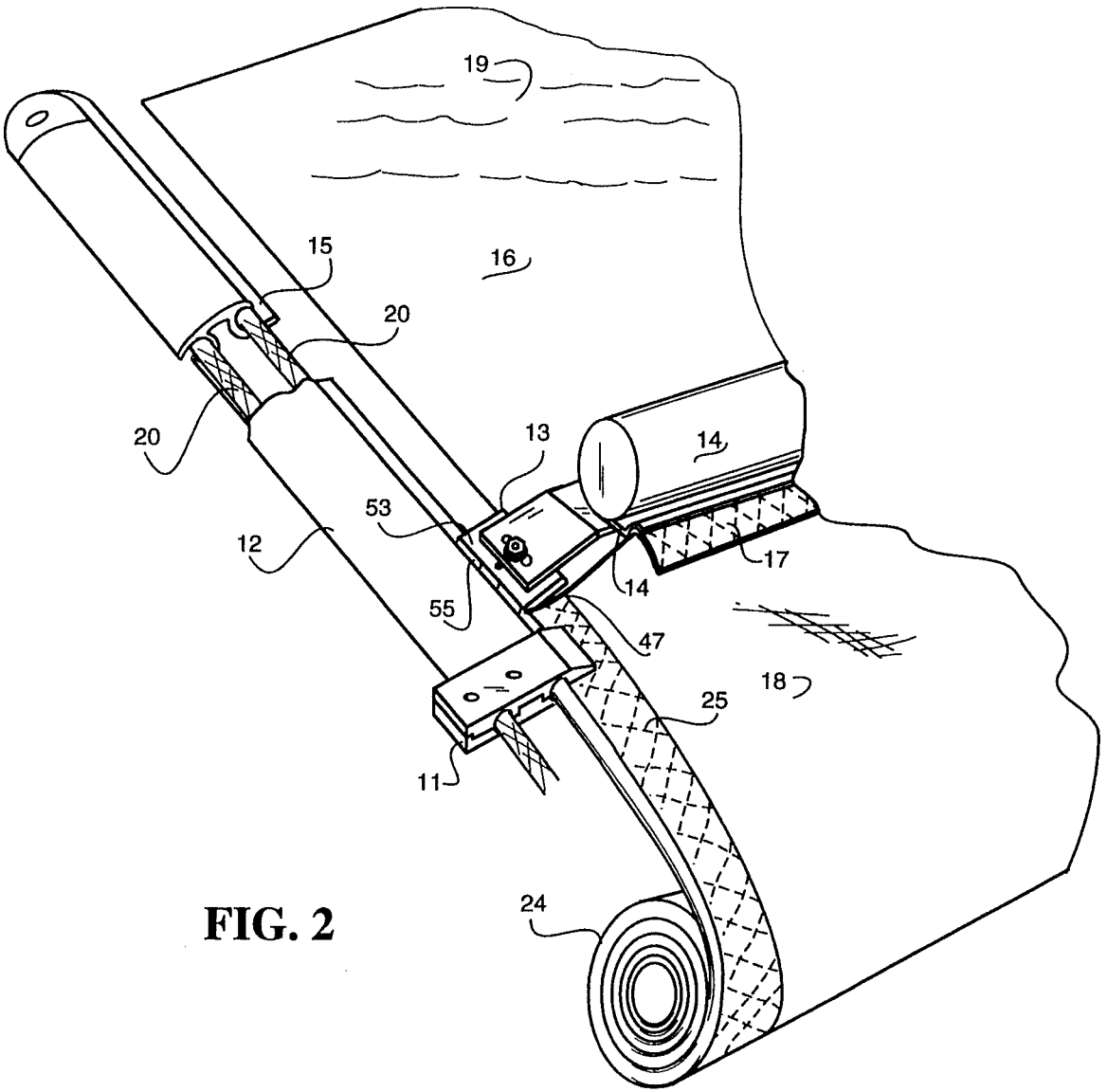
FIG. 2 is a shows a perspective of the invented split stop located at the cover drum end of a conventional deck swimming pool track for arresting translation of a slider carrying the rigid lead edge of an automatic swimming pool cover system

Referring to FIGS. 1 and 2 the invented split stops 11 are secured at the terminal ends of conventional extruded aluminum swimming pool cover track 12 along opposite sides of a swimming pool 16 for arresting translation of sliders 13 captured and sliding within the "C" channel 15 of the track 12. The sliders 13 carry the rigid boom or leading edge 14 which spans the width of the swimming pool 16 holding the front edge 17 of the pool cover 18 above the water surface 19. The sliders 13 are secured by screws to cables 20 extending from the beaded tape side edges 25 of the pool cover. [See U.S. Pat. No. 4,939,798, FIGS. 2, 11, & 12] FIG. 1 illustrates two split stops 11 located at each end of track 12 secured to the underside 21 of an overhanging coping 22 along one wall 23 of the swimming pool 16. FIG. 2 illustrates a single stop 11 terminating a conventional deck track 12 proximate the cover drum 24 around which the pool cover 18 winds. As shown in the FIGS. 1 & 2 the beaded tape side edge 25 of the pool cover 18 is captured and slides within the "C" channel 15 of the extruded aluminum pool cover tracks 12.

It should also be appreciated that FIGS. 1 & 2 show the location of invented split stops 11 only with respect to one of the tracks 12 secured along one of the sides of the swimming pool. Identical split stops 11 must be located for arresting translation of the slider 13 captured and sliding in the "C" channel of the track 12 on the opposite side of the pool 16 at essentially the same longitudinal position such that, when arrested by the stops 11, the rigid leading edge 14 is perpendicularly oriented between the pair parallel tracks secured on opposite sides of the pool. [See Applicant's U.S. Pat. Nos. 4,939,798 and 5,067,184 for detailed discussion and description of leading edge, slider and cover drum systems for automatic swimming pool covers.]

Figure 3A:
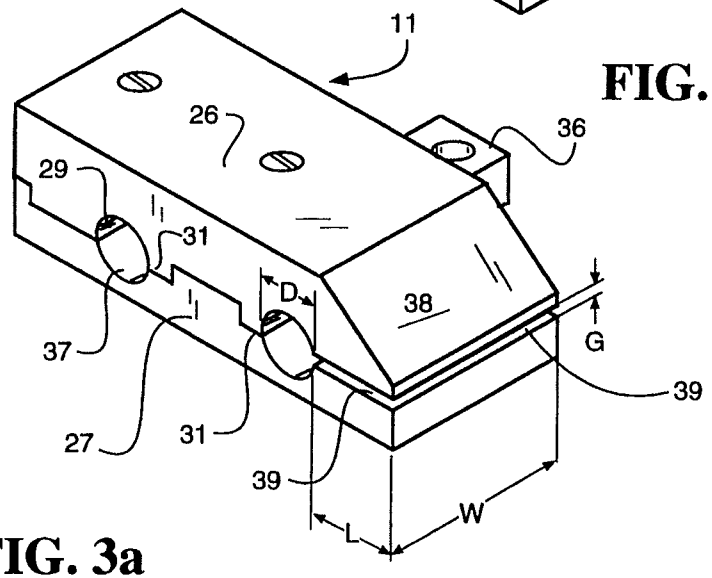
FIGS. 3 and 3*a* shows a perspective of an exploded and an assembled embodiment of the invented spilt stop, respectively.
Figure 3:
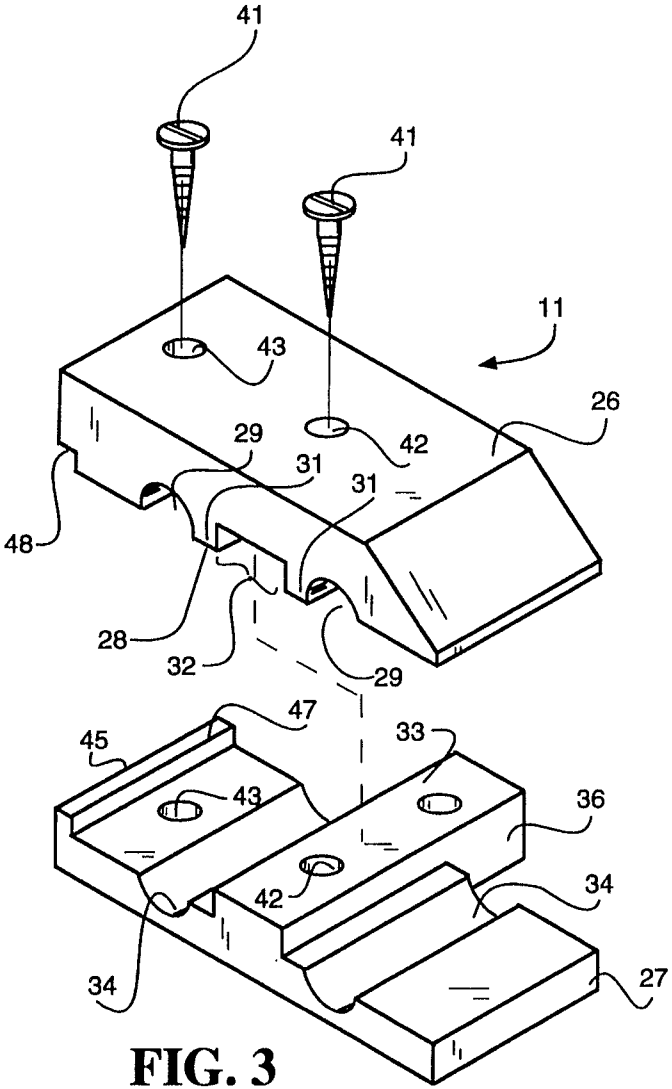

Looking now at FIGS. 3 & 3*a*, the invented split stop 11 includes a top member 26 and a base member 27. The top member 26 has a mating surface 28 with two parallel half cylinder channels 29 with lands 31 defining an alignment slot 32 between the channels 29. The mating surface 28 of the top member 26 seats on a complementary mating surface 33 of the base member 27 which also has two parallel half cylinder channels 34 but with a central alignment rail 36 aligned between the channels 34. The central alignment rail 36 extends perpendicularly from one side of the base member 27 and is dimensioned for insertion into the rectangular space between the respective "C" and rope channels of typical pool cover track. The alignment slot 32 in the top member 26 is dimensioned to receive the alignment rail 36. The mated surfaces 28 & 33 of the top and base members 26 & 27 define a cylindrical rope channel 37, and a cylindrical beaded tape channel 38 with a longitudinally 25 communicating gap 39. (FIG. 3*a*) The alignment rail 36 extending from the side of the invented stop 11, when inserted into the rectangular space between the rope and "C" channels of the track 12, aligns the rope and beaded tape channels 37 & 38 of the split stop with the corresponding the rope and "C" channels of the track. [See Applicant's U.S. Pat. No. 4,939,798, FIG. 9, & discussion at col. 16, 1.58 through col. 17,1.23] At least two screws 41 received in holes 42 drilled centrally through the alignment slot 32 of the top member 26 and the alignment rail 36 of the base member 27 and in holes 43 drilled through the tail sections 45 of the top and base members 26 & 27 simultaneously secure the top and base members 26 & 27 together and the stop 11 to the pool deck or coping surface 21 (FIGS. 1 & 2).

With reference to FIGS. 1, 2, 3 & 3*a*, the beaded tape channel 38 of the invented split stop 11 is appropriately dimensioned to arrest translation of the slider 13 at the end of the pool track 12. In particular, either (i) the length L between the circular bore of the beaded tape channel and the end of the nose 46 of the spilt stop 11 is greater than the length of the necked section 55 of the slider element 13 supporting the rigid leading edge 14 of the cover 18, and/or (ii) the width G of the longitudinal gap 39 of the beaded tape channel 38 is less than the thickness of the necked section 55 of a slider, and/or (iii)

the diameter D of the circular bore of the beaded tape channel 38 is less than the outside diameter of the hollow cylindrical sliding edge 35 of the slider 13. [See Applicant's U.S. Pat. No. 4,939,798, FIGS. 2, 7, 8, and 11–12*a*, and the discussion at col. 10, 1.3 through col. 16, 1.57, for a detailed description of the sliders 13.] The width G of the longitudinal gap 39 of the beaded tape channel 38 should be sufficiently great to allow the beaded tape side edges 25 of the pool cover 18 to slide freely through it as the cover is extended and retracted back and forth across the pool 16.

The mating surfaces 28 & 33 of the top and base members 26 & 27 of the invented spilt stop may also include a tail land 47 on one of the surfaces and a corresponding relief 48 cut into the other surface located at or proximate the 'tail' 45 of the stop 11 to enhance the rigidity of the coupling between the mating surfaces. Such tail lands 47 and reliefs 48 also facilitate installation and replacement in that they enable the installer/-repairman to easily distinguish between the tail and nose of the top and base members 26 & 27 of the stop 11.

Finally, to preclude the front edge 51 of the beaded tape side edges 25 of the cover 18 from snagging and/or catching, the width W of the stop 11 should be chosen such that the front edge 47 always remains either within the beaded tape channel 38 of the invented stop 11 or within the "C" channel 15 of the track 12 at the point where the stop 11 arrests translation of the slider 13.

However, as mentioned previously, the distance between the sliders 13 carrying the rigid leading edge 14 and front edges 47 of the beaded tape edges 25 of the cover 18 may vary over the life of a pool cover 18 due to stretching, aging, repair, and adjustment. With embodiments of the spilt stop 11 shown in FIGS. 1–3*a*, when the distance between the slider and front edge 51 of the beaded tape exceeds the width of the stop 11, it would be necessary to replace those stops with stops of greater width. Alternatively, the embodiments of the invented stops 11 shown FIGS. 4, 5 and 6 allow for adjustment of the position at which the stop 11 arrests translation of the slider 13.

Figure 4:
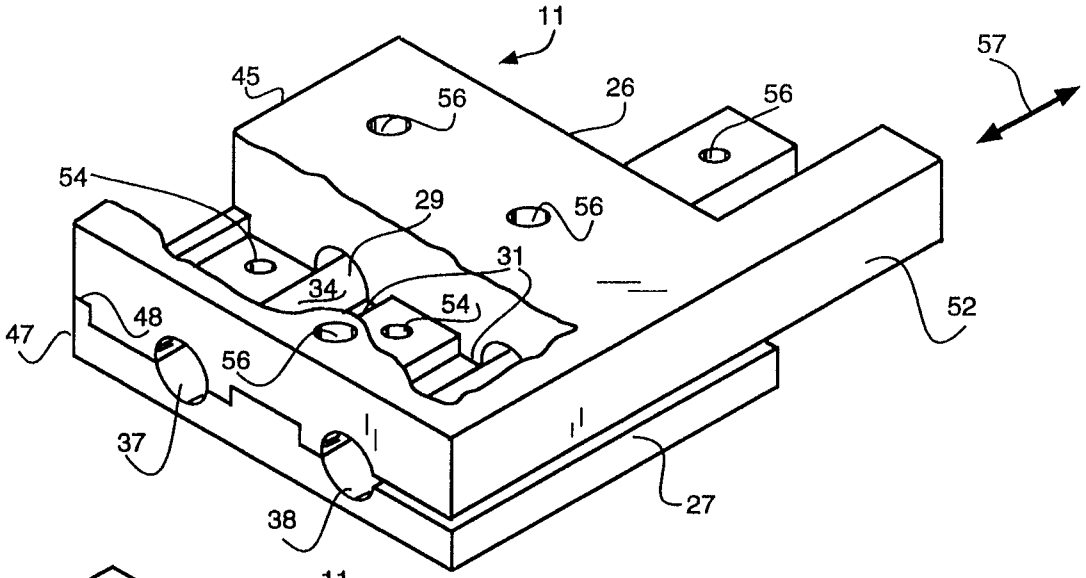
FIG. 4 shows a cut away perspective of an embodiment of the invented spilt stop where the top member includes a nose prong and is adapted to translate longitudinally with respect to the base member.

For example, the top member 26 of the stop 11 shown in FIG. 4 includes a nose prong 52 adapted to extend down the track exterior the "C" channel 15 in which the slider 13 slides, to engage the body 53 of the slider. The base member 27 is adapted to be secured at the end of the track with the alignment rail 36 inserted in the rectangular space between the respective "C" and rope channels of the pool cover track. A series of aligned holes 54 are drill through the alignment rail 36 and tail 45 of the base member 27. A corresponding series of aligned holes 56 are drilled through the central alignment slot 32 and tail 45 of top member 26. The position of the top member 26 may then adjusted translating it along the width of the base member (as indicated by the arrow 57) to determine the point at which translation of the slider is arrested. Screws 41 received in registering holes 54 and 56 secure the top member 26 to the base member 27.

Figure 5:
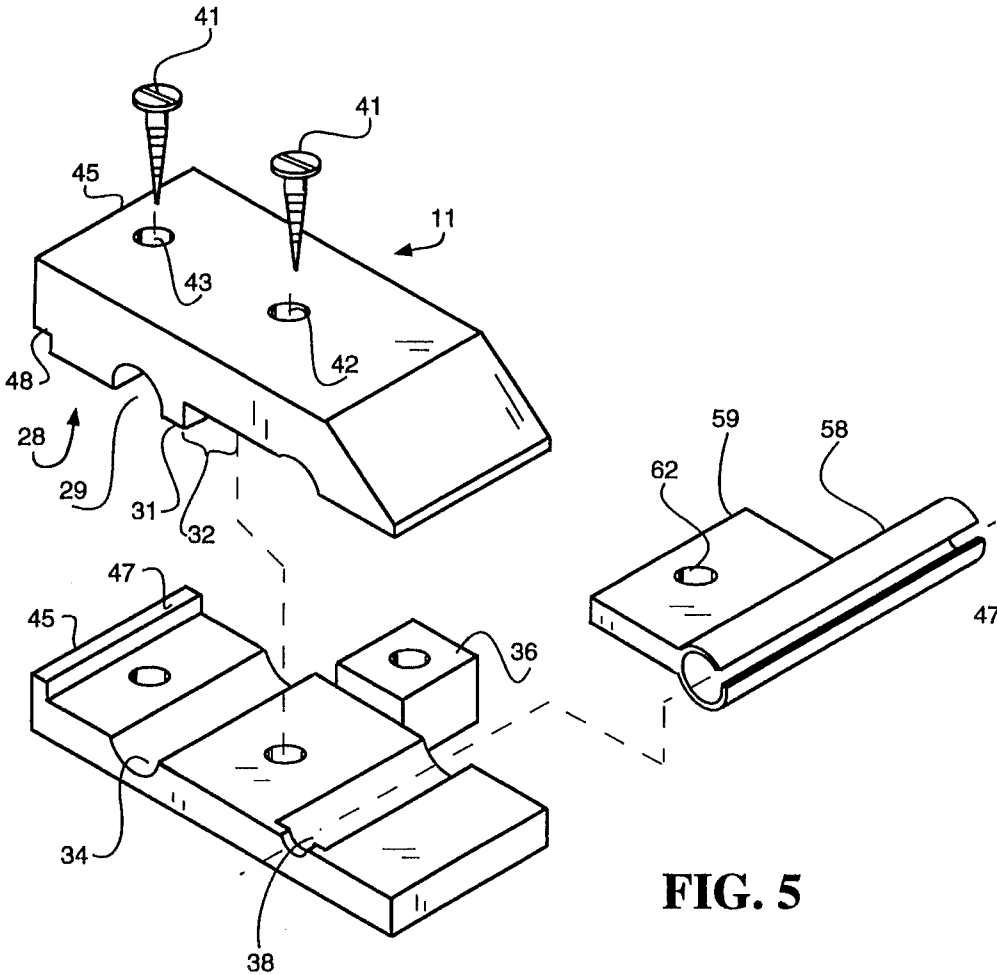
FIG. 5 shows an exploded perspective of another embodiment of the invented spilt stop with an slotted insert sleeve having an anchor tab at one end.

In the embodiment of the invented stop 11 shown in FIG. 5, a slotted insert sleeve 58 is sandwiched in the beaded tape channel 38. In this embodiment, the slotted tube is dimensioned for insertion into the "C" channel of the track 12 for reducing the diameter of the "C" channel 15 of the track 12 to a diameter less than that of the hollow cylindrical sliding edge 35 of the slider 13 but greater than that of the cable 20. The slotted tube insert 58 includes an anchoring tab 59 at one end extending perpendicularly with respect to the axis of the sleeve. A section of the central alignment rail 36 of the bottom member 27 is cut away, as is the corresponding section of the shoulder between central alignment slot 32 and the beaded tape channel 38 of the top member to accommodate the anchoring tab 59 of the slotted tube insert 58. A hole 62 is drilled through the anchoring tab 59 located to register with the hole 42 drilled through the center of the stop 11. A second hole 43 is drilled through the tail sections 45 of the top and base members of the stop. Screws 41 secure the respective top, base and slotted sleeve insert members together and the stop 11 to the pool deck or coping surface 21. Adjustment of the position at which translation of the slider is arrested is accomplished by either substituting a longer sleeve or by shortening an existing sleeve by cutting off sections.

Figure 6:
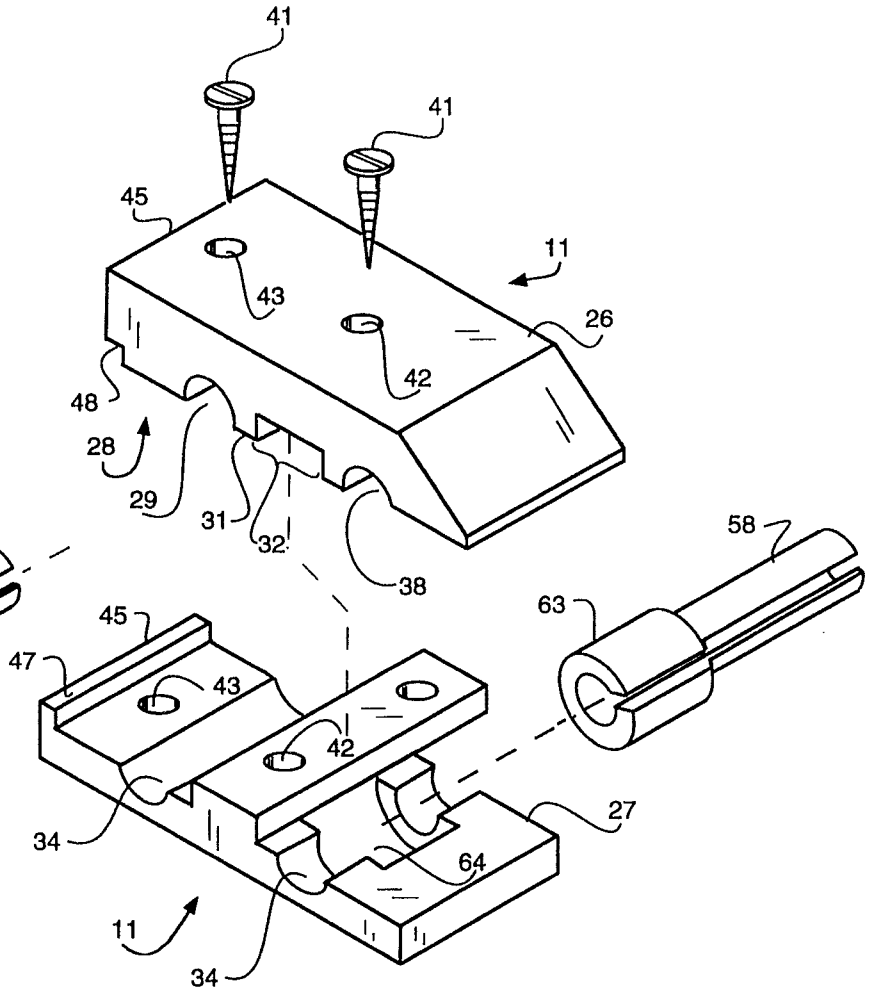
FIG. 6 shows an exploded perspective of still another embodiment of the invented spilt stop for accommodating an slotted insert sleeve having an annular collar adapted to be received in a annular slot cut into the beaded tape channel defined by the mating surfaces of its top and bottom members.

FIG. 6 shows another embodiment of a slotted sleeve insert 58 for the invented split stop 11. In particular, the slotted sleeve 58 has a raised annular shoulder 63 at one end which is adapted to be received in a corresponding annular relief 64 cut into the walls of the half cylinder channels 29 & 34 of the top and bottom members 26 & 27 defining the beaded tape channel 38 of the stop 11. The annular shoulder 63 anchors the sleeve in the beaded tape channel 38 preventing it from sliding longitudinally responsive to the friction of the beaded side edge 25 sliding through the stop.

The invented split stops for automatic swimming pool cover systems having hydraulic motor drives have been described in context of both representative and preferred embodiments. There are many modifications and variations can be made to the invented stop which, while not exactly described herein, fall within the spirit and the scope of invention as described and set forth in the appended claims.

I claim:

1. In a pool cover system including a flexible fabric cover winding and unwinding from a cover drum located at one end of a pool wherein:

A) the cover has parallel beaded side edges each captured and sliding within a "C" channel of a pool cover track secured along opposites sides of the pool and a front edge supported by a rigid structural boom spanning the pool supported by a pair of sliders each captured and siding within a "C" channel of a pool cover track;

B) each slider is anchored to a cable extending from a front corner of each beaded side edge of the cover which winds and unwinds from a cable reel; and C) the cover drum and cable reels are each rotated by a hydraulic motor for retracting and extending the cover across the pool, an improvement, comprising in combination therewith, at least a pair of positive stops for arresting translation of the respective sliders sliding with in the "C" channels of the pool cover track toward the cover drum located at each end of each pool cover track proximate the cover drum, each stop including:

a) a top member having a mating surface with two parallel half cylinder channels with lands defining an alignment slot between the channels, b) a base member having a complementary mating surface to that of the top member with two parallel half cylinder channels and a central alignment rail between the channels dimensioned to fit into the alignment slot of the top member, the alignment rail extending perpendicularly from a side of the base member, and c) means for securing the top and base members together and at the respective ends of the parallel pool cover tracks with the alignment rail extending perpendicularly from the side of the base member inserted into a rectangular space between the "C" channel and a cable return channel of the pool cover track which aligns the mating half cylinder channels of the top and base members with the corresponding cable return and "C" channels of the track, the mating surfaces of the top and base members defining:

(i) a cylindrical cable channel; and (ii) a longitudinally slit, cylindrical, beaded cover edge channel dimensioned for stopping translation of the slider while allowing passage of the beaded side edge of the pool cover to through the stop.

2. A positive stop for arresting translation of a slider captured and sliding within a "C" channel of a pool cover track anchored to a cable extending from a front corner of a beaded side edge of a pool cover at an end of the pool cover track, comprising, in combination, a) a top member having a mating surface with two parallel half cylinder channels with lands defining an alignment slot between the channels, b) a base member having a complementary mating surface to that of the top member with two parallel half cylinder channels and a central alignment rail between the channels dimensioned to fit into the alignment slot of the top member, the alignment rail extending perpendicularly from a side of the base member, and c) means for securing the top and base members together and at the end of the pool cover track with the alignment rail extending perpendicularly from the side of the base member inserted into a rectangular space between the "C" channel and a cable channel of the pool cover track which aligns the mating half cylinder channels of the top and base members with the corresponding cable return and "C" channels of the track, the mating surfaces of the top and base members defining:

(i) a cylindrical cable channel; and (ii) a longitudinally slit, cylindrical, beaded cover edge channel dimensioned for stopping translation of the slider while allowing passage of the beaded edge of the cover through the stop.

3. A positive stop as described in claim 1 or 2 wherein the beaded side edge of the pool cover has a maximum diameter dimension, and the slider anchored to the cable has a minimum diameter dimension greater than the maximum diameter of the beaded side edge of the pool cover, and the longitudinally slit, cylindrical, beaded cover edge channel has a diameter dimension greater than the maximum diameter of the beaded side edge of the pool cover and less than minimum diameter dimension of the slider anchored to the cable extending from the beaded edge.

4. A positive stop as described in claim 3 wherein the slider is anchored to the cable a distance 'd' measured along the cable from the beaded side edge of the pool cover, and the top and base members of the stop have a width 'w' measured parallel the cylindrical beaded edge channel where 'w' is greater than 'd' such that the beaded side edge of the cover always remains within the longitudinally slit, cylindrical, beaded cover edge channel of the stop.

5. A positive stop as described in claim 1 or 2 wherein the pool cover has a maximum thickness adjacent its beaded edge, and the slider anchored to the cable has a minimum thickness adjacent to the cable greater than the maximum thickness of the pool cover, and the longitudinal slit of the beaded cover edge channel has a gap width greater than the maximum thickness of the pool cover and less than the minimum thickness of the slider adjacent the cable.

6. A positive stop as described in claim 5 wherein the slider is anchored to the cable a distance 'd' measured along the cable from the beaded side edge of the pool cover, and the top and base members of the stop have a width 'w' measured parallel the cylindrical beaded edge channel where 'w' is greater than 'd' such that the beaded side edge of the cover always remains within the longitudinally slit, cylindrical, beaded cover edge channel of the stop.

7. A positive stop as described in claim 1 or 2 wherein the slider has a strike section exterior the "C" channel of the track, and wherein the top member of the stop has a nose section which extends perpendicularly toward the pool beyond the "C" channel of the track to a position for intercepting the strike section of the slider.

8. A positive stop as described in claim 7 wherein the slider is anchored to the cable such that its strike section is distance 'd' measured along the cable from the beaded side edge of the pool cover, and the top and base members have a width 'w' measured parallel the cylindrical beaded edge channel where 'w' is greater than 'd', whereby, the beaded side edge of the cover always remains within the longitudinally slit, cylindrical, beaded cover edge channel of the stop.

9. A positive stop as described in claim 7 wherein the nose section of the top member has a prong which extends along and exterior the "C" channel of the track for intercepting the strike section of the slider arresting translation of the slider before it reaches the end of the of the pool cover track, whereby, the distance measured from the end of the track at which the stop is arrested may be adjusted by adjusting the length of the nose prong.

10. A positive stop as described in claim 1 or 2 and further including a slotted sleeve element anchored at one end in the longitudinally slit, cylindrical, beaded cover edge channel of the stop and extending down the "C" channel of the pool cover track for arresting translation of the slider before it reaches the end of the track, the slotted sleeve element having a bore diameter and a slot gap dimension for allowing passage of the beaded pool cover edge and preventing passage of the slider, whereby, the distance from the end of the track at which the slider is arrested may be adjusted by adjusting the length the sleeve extends down the "C" channel of the track.

11. A positive stop as described in claim 10 wherein the slotted sleeve element has an anchoring tab at its anchored end which extends perpendicularly with respect to its longitudinal axis, and wherein the means for securing the top and base members together and at the end of the pool cover track also secures the anchoring tab of the slotted sleeve within the stop.

12. A positive stop as described in claim 10 wherein the slotted sleeve includes a raised exterior annular shoulder at its anchored end which is received in a cylindrical relief cut into the cylindrical walls of the mating surfaces of the top and base members defining the longitudinally slit, cylindrical, beaded cover edge channel of the stop.

13. An automated pool cover system for covering and uncovering a pool of liquid, comprising in combination, a) a flexible fabric cover winding and unwinding from a cover drum located at one end of a pool sized for floating upon the liquid in the pool and having a front edge, and parallel beaded side edges captured and sliding within "C" channels of parallel pool cover tracks secured along opposites sides of the pool, b) a rigid structural boom spanning the pool supported by a pair of sliders each captured and siding within a "C" channel of a pool cover track supporting the front edge of the cover above the liquid in the pool wherein each slider is anchored to a cable extending from each front corner of the beaded side edge of the cover which winds and unwinds from a cable reel, c) at least one hydraulic motor coupled for rotating the cover drum and cable reel for retracting and extending the cover across the pool, d) positive stops for arresting translation of the respective sliders sliding with in the "C" channels of the pool cover track toward the cover drum located at each end of each pool cover track proximate the cover drum, each stop including:

(i) a top member having a mating surface with two parallel half cylinder channels with lands defining an alignment slot between the channels, (ii) a base member having a complementary mating surface to that of the top member with two parallel half cylinder channels and a central alignment rail between the channels dimensioned to fit into the alignment slot of the top member, the alignment rail extending perpendicularly from a side of the base member, and (iii) means for securing the top and base members together and at the respective ends of the parallel pool cover tracks with the alignment rail extending perpendicularly from the side of the base member inserted into a rectangular space between the "C" channel and a cable channel of the pool cover track which aligns the mating half cylinder channels of the top and base members with the corresponding cable return and "C" channels of the track, the mating surfaces of the top and base members defining:

(iv) a cylindrical cable channel; and (v) a longitudinally slit, cylindrical, beaded cover edge channel dimensioned for stopping translation of the slider while allowing the beaded edge of the pool cover to slide through the stop.

14. The automated pool cover system of claim 13 and further including positive stops for arresting translation of the respective sliders sliding with in the "C" channels of the pool cover track away from the cover drum located at each end of each pool cover track distant from the cover drum, each stop including:

(vi) a top member having a mating surface with two parallel half cylinder channels with lands defining an alignment slot between the channels, (vii) a base member having a complementary mating surface to that of the top member with two parallel half cylinder channels and a central alignment rail between the channels dimensioned to fit into the alignment slot of the top member, the alignment rail extending perpendicularly from a side of the base member, and (viii) means for securing the top and base members together and at the respective ends of the parallel pool cover tracks with the alignment rail extending perpendicularly from the side of the base member inserted into a rectangular space between the "C" channel and the return cable channel of the pool cover track which aligns the mating half cylinder channels of the top and base members of the stop with the corresponding cable return and "C" channels of the track, the mating surfaces of the top and base members defining two cylindrical cable channels being dimensioned for stopping translation of the slider while allowing passage of the cable.

* * * * *